US007748247B2

(12) United States Patent
Martin et al.

(10) Patent No.: US 7,748,247 B2
(45) Date of Patent: Jul. 6, 2010

(54) REGULATING FLATNESS OF A METAL STRIP AT THE OUTPUT OF A ROLL HOUSING

(75) Inventors: Sebastien Martin, Neuilly sur Seine (FR); Franck Serval, Saint-Etienne (FR); Laurent Dorel, Saint Chamond (FR); Yves Leclercq, L'etang-la-Ville (FR); Rodolphe Le Riche, Saint-Etienne (FR); Xavier Bay, Saint Germain Laprade (FR)

(73) Assignee: Siemens VAI Metals Tecnhnologies SAS, Saint-Chamond (FR)

( * ) Notice: Subject to any disclaimer, the term of this patent is extended or adjusted under 35 U.S.C. 154(b) by 336 days.

(21) Appl. No.: 11/722,205

(22) PCT Filed: Dec. 9, 2005

(86) PCT No.: PCT/FR2005/003097

§ 371 (c)(1),
(2), (4) Date: Oct. 19, 2007

(87) PCT Pub. No.: WO2006/070087

PCT Pub. Date: Jul. 6, 2006

(65) Prior Publication Data

US 2009/0249849 A1 Oct. 8, 2009

(30) Foreign Application Priority Data

Dec. 22, 2004 (FR) ..... 04 13753

(51) Int. Cl.
*B21B 37/28* (2006.01)

(52) U.S. Cl. ..... 72/11.7; 72/7.1; 72/7.6; 700/154

(58) Field of Classification Search ..... 72/7.1, 72/7.4, 8.9, 9.1, 11.6, 11.7, 7.6; 73/862.07; 700/148, 154
See application file for complete search history.

(56) References Cited

U.S. PATENT DOCUMENTS 4,400,957 A * 8/1983 Carlstedt et al. ..... 72/9.1
5,379,631 A * 1/1995 Kira et al. ..... 73/37.5

(Continued)

FOREIGN PATENT DOCUMENTS

| | | |
|---|---|---|
| DE | 195 03 363 | 9/1995 |
| JP | 60234709 | 11/1985 |
| JP | 63056309 | 3/1988 |

OTHER PUBLICATIONS

Olsson, "Approaching the absolute in flatness control of cold rolled strip", Steel Times International, (Inc. steel Times), DMG World Media, Redhill, Surrey, GB, vol. 15, No. 3, pp. 45-46, XP000205352, 1991.

*Primary Examiner*—Edward Tolan
(74) *Attorney, Agent, or Firm*—Laurenc A. Greenberg; Werner H. Stemer; Ralph E. Locher

(57) ABSTRACT

A method regulating flatness of a metal strip at a roll housing output including at least one dynamic flatness actuator. A rolling process characterizes flatness of the strip by measuring a quantity D in n points distributed across the strip width, from n measurements of the quantity D. Then, using an action model of flatness regulation and an optimizing method, an overall setpoint including at least one elementary setpoint is determined for the dynamic actuator, such that a calculated flatness residual defect criterion is minimal, and executing the overall setpoint. The action model on the flatness used for determining the overall setpoint includes, for the dynamic actuator, as many submodels as there are points for measuring the quantity D characteristic of flatness, each submodel enabling the effect of the dynamic actuator on the quantity D to be calculated at the corresponding point when a setpoint is applied thereto.

23 Claims, 2 Drawing Sheets

U.S. PATENT DOCUMENTS 5,535,129 A * 7/1996 Keijser ..... 700/148
6,314,776 B1 * 11/2001 Puda ..... 72/10.1
6,513,358 B2 * 2/2003 Jonsson et al. ..... 72/9.1
6,697,699 B2 * 2/2004 Gramckow et al. ..... 700/154
6,721,620 B2 * 4/2004 Jelali et al. ..... 700/148
7,031,797 B2 * 4/2006 Reinschke et al. ..... 700/150

* cited by examiner

REGULATING FLATNESS OF A METAL STRIP AT THE OUTPUT OF A ROLL HOUSING

The present invention relates to the regulation of the flatness of a metal strip at the output of a roll stand equipped with a means for regulating flatness including at least one dynamic flatness actuator.

The manufacture of flat metal products, such as strips for example, is generally performed by rolling and most often by rolling on rolling trains consisting of a plurality of roll stands having rolls intended to flatten the rolled strip, disposed behind one another and traversed in succession by the strip.

This rolling may either be hot rolling, where the strip is obtained by rolling a pre-heated slab or produced by thin strip casting, or cold rolling, where the strip is obtained by additional rolling of a strip obtained previously by hot rolling. In both cases, the strip is spooled at the output of the rolling mill.

During such rolling, in particular because of deformations of the rolling rolls as a result of the pressure exerted on the product during rolling, the transverse profile of the strips obtained is in general not perfectly rectangular.

In addition, if the sequence of profiles from one rolling operation to the next is not adjusted appropriately, the different fibres of the strip are not elongated identically. This may result in flatness defects which manifest themselves in non-developable corrugations distributed across one part only of the width of the strip. These corrugations may be situated along the centre line of the strip, when the defect is called centre buckle, or on one or both edges of the strip, when the defect is called edge wave, or in the intermediate parts between the centre line of the strip and the edges of the strip.

Flatness defects which are generally clearly visible during hot rolling are generally less visible during cold rolling because of the tension applied to the strips during cold rolling.

Whether they are visible or whether they are not directly visible, flatness defects may nevertheless be measured by suitable means which are for example flatness measuring rolls. In order to limit flatness defects, steps can be taken to limit deformations of the rolls of the rolling mill and in particular deformations of the work rolls. These steps depend on the nature of the rolling mill. In fact, strips are generally rolled in rolling mills consisting of what are called quarto roll stands, that is, of roll stands including two work rolls each resting on a support roll of a larger diameter, but strips may also be rolled on what are called sexto roll stands, whose work rolls rest on intermediate rolls moveable in lateral translation which in their turn rest on support rolls of a larger diameter.

In all cases, the transverse profile of the strips at the output of each roll stand may be at least partially controlled, and consequently flatness problems may be limited. This control may be effected by adjusting the ground camber of the rolls, that is, the variation in the diameter of the rolls along their length produced when their surface is ground, producing a cambering of the cylinders, that is, a deflection (exerted on the roll necks) resulting from counter-deflection forces and opposing the deflection forces resulting from the rolling force, ensuring a slight crossing of the axis of the work rolls relative to the axis of the support rolls, which modifies the support conditions of the work rolls on the support rolls and, consequently, the transverse distribution of pressure on the rolls and thus the deformation of the rolls.

On a sexto roll stand, it is also possible to adjust the behaviour of the mill to the width of the strip to be rolled by moving the intermediate rolls in translation and by setting them at a position dependent on the width of the strip to be produced.

Variable camber rolls have also been devised, these being support rolls consisting of a moveable external casing rotationally mounted around a support and connected to this support by means of jacks capable of exerting pressure towards the air gap of the work rolls. These jacks, disposed along the length of the variable camber roll, enable the distribution of the pressure of the support rolls on the work roll to be adjusted as required according to the width of the strip which is being rolled.

It is also possible to use nozzles for spraying the rolls, which nozzles provide spraying distributed appropriately along the rolling line. This spraying has an effect on the surface temperature of the rolls and, in this way, an effect on their diameter because of thermal expansion.

Finally, to avert or resolve problems of asymmetry between the two sides of the strip, it is possible to adjust the roll gap from either side of the stand, and thus give the rolls lateral tilt. All these means for adjusting the mills may be pre-positioned before a strip is rolled which in theory makes it possible to obtain a strip with a profile of the desired thickness and which is very flat or has a controlled defect.

However, these a priori adjustments are not sufficient. In fact, for several reasons, the characteristics of the strips are not constant along their entire length. The result of this is that, although in a defined part of the strip the mill is optimally adjusted to obtain a very flat strip, it is not necessarily the case that this mill is appropriately adjusted for another part of the strip.

In order to overcome this disadvantage, it has been proposed that the flatness of the strip at the output of a roll stand be measured and that this measurement of flatness be used to act on certain parameters for adjustment of the roll stand.

These parameters are parameters for adjustment of an actuator known as dynamic, that is, an actuator whose settings may be modified during rolling. In fact, amongst the actuators which have been mentioned, some cannot be modified during rolling simply because the forces which would have to be applied would be too great, others cannot be so modified because of their nature.

The actuators which cannot be adjusted during rolling are known as static actuators. These are for example the ground camber of the rolls, the lateral translation of an intermediate roll in a sexto roll stand or the crossing of the work rolls.

The other actuators, known as dynamic actuators because they can be modified during rolling, are the camber of the work rolls or of the intermediate rolls, if there are any, each jack for adjusting the camber of a variable camber roll, the opening or closing of this or that spray nozzle of a spray bar, and finally the tilt of the rolls.

In order to continuously adjust flatness, measurements taken by a flatness measuring device are normally used in order to represent the flatness error of the strip in the form of a polynomial approximation.

This polynomial approximation is used to determine the setting values to be applied by the dynamic actuators available on the roll stand concerned.

This method, based on a polynomial approximation, has the disadvantage of not being very precise and, in addition, of being difficult to apply in order to control a complex dynamic flatness actuator, such as a roll with an adjustable camber which in reality corresponds to a plurality of independent elementary actuators.

The aim of the present invention is to overcome this disadvantage by proposing a means for controlling dynamic flatness actuators during rolling of a thin metal strip which is more precise than the means known in the prior and which in particular can easily be applied to the control of complex actuators, such as rolls with an adjustable camber.

To that end, the subject of the invention is a process for regulating the flatness of a metal strip at the output of a roll stand having a means for regulating flatness including at least one dynamic flatness actuator. According to this process, during rolling, the flatness of the strip is characterised by the measurement of a quantity D at n points distributed over the width of the strip. On the basis of the n measurements of the quantity D, and using a model of the effect on flatness of the means for regulating flatness and an optimisation method, an overall setpoint is determined for the regulating means, said overall set-point including at least one elementary set-point for a dynamic actuator, so that a calculated residual flatness error criterion is minimal. Then the overall set-point is implemented by the means for regulating flatness. In this process, the model of effect on flatness used to determine the overall set-point is built up for the dynamic actuator, with as many submodels as there are points of measurement of the quantity D characteristic of flatness, each submodel making it possible to calculate the effect on the quantity D, at the relevant point, of the relevant dynamic actuator when a set-point value is applied to it.

Preferably, the overall set-point is determined in such a way that the application of the overall set-point is compatible with the operational constraints of the actuators.

The dynamic actuator or actuators consist for example of at least one of the following means: setting of the camber of the work rolls or the intermediate rolls, jack for internal adjustment of the pressure of a variable camber support roll, sprinkler nozzle, tilt of the rolls.

Preferably, the means for regulating flatness includes a plurality of dynamic actuators, and the overall set-point includes an elementary set-point for each of the dynamic actuators and in order to determine the overall set-point, a calculation is performed for example of the sum total of the effects of each of the dynamic actuators on flatness in order to determine the calculated residual flatness error.

In general, the model of the effect of a dynamic actuator is dependent on the width of the strip.

The means for regulating flatness may also include at least one static flatness actuator preset before the strip is rolled, according to the width of the strip to be rolled, and the models of dynamic actuators may be determined by taking into account the preset settings of the static actuators.

The at least one static actuator is for example the lateral translation of the rolls or the crossing of the rolls.

The calculated residual flatness error criterion may be an increasing positive function of at least one norm of the difference between the calculated residual flatness error and a target flatness error.

The calculated residual flatness error criterion may, for example, be the quadratic difference of the calculated residual error. The calculated residual flatness error criterion may also be the maximum amplitude of the calculated residual error. The error criterion may also be a combination of the two preceding criteria.

The calculated residual flatness error criterion may, in addition, include a static cost factor and/or a dynamic cost factor.

Preferably, the number n of points of measurement of the quantity D characteristic of flatness is dependent on the width of the strip.

The quantity D is measured, for example, using a flatness measuring device such as a flatness measuring roll having a plurality of measurement zones distributed transversely across the width of the rolling line.

Preferably, the evaluation of the flatness error, the definition of the set-points for the dynamic actuators and the adjustment of the dynamic actuators is performed at successive intervals of time.

The successive intervals of time may be dependent on the running speed of the strip, and may for example be inversely proportional to that speed.

The preset settings for rolling and the models of the effect of the elementary actuators may be determined using a simulation model of rolling on a roll stand.

Preferably, before a strip is rolled, a simulation model of rolling is used to calculate the preset set-points for the static and dynamic actuators appropriate to the rolling of the strip, the models of the effect of the elementary dynamic actuators are calculated by linearisation near the preset settings, the roll stand is preset and the parameters for the models of the effect of the elementary dynamic actuators are sent to a regulating device.

According to the process, at least one additional rolling parameter can also be measured, such as, in particular, rolling force or tension, and before determining an overall set-point for the regulating means by using a model of the effect of the regulating means and an optimisation method, a preferred action model is used to determine at least one adjustment of a set-point for a preferred dynamic actuator and this adjustment or these adjustments are taken into account in determining the overall set-point for the regulating means.

The preferred dynamic actuator may be the camber of the work rolls.

The process according to the invention may be implemented by computer and it is applied in particular to cold rolling.

Finally, the invention relates to the software for implementation of the process.

The invention will now be described in a manner which is more precise but non-limiting and in relation to the appended drawings in which.

Figure 1:
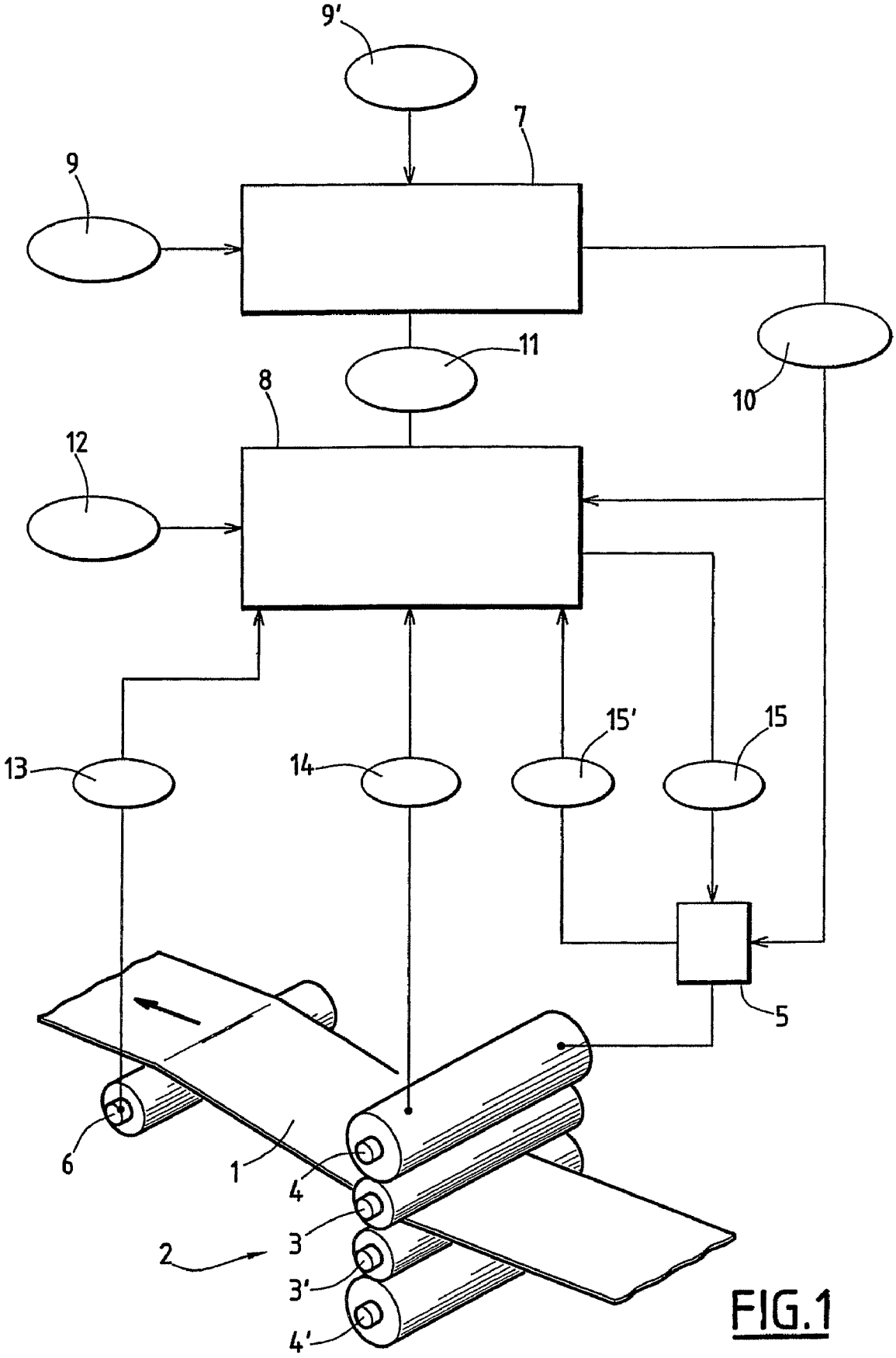
FIG. 1 is an overall diagram of a flatness regulation process of a quarto roll stand provided with a flatness measuring roll.
Figure 2:
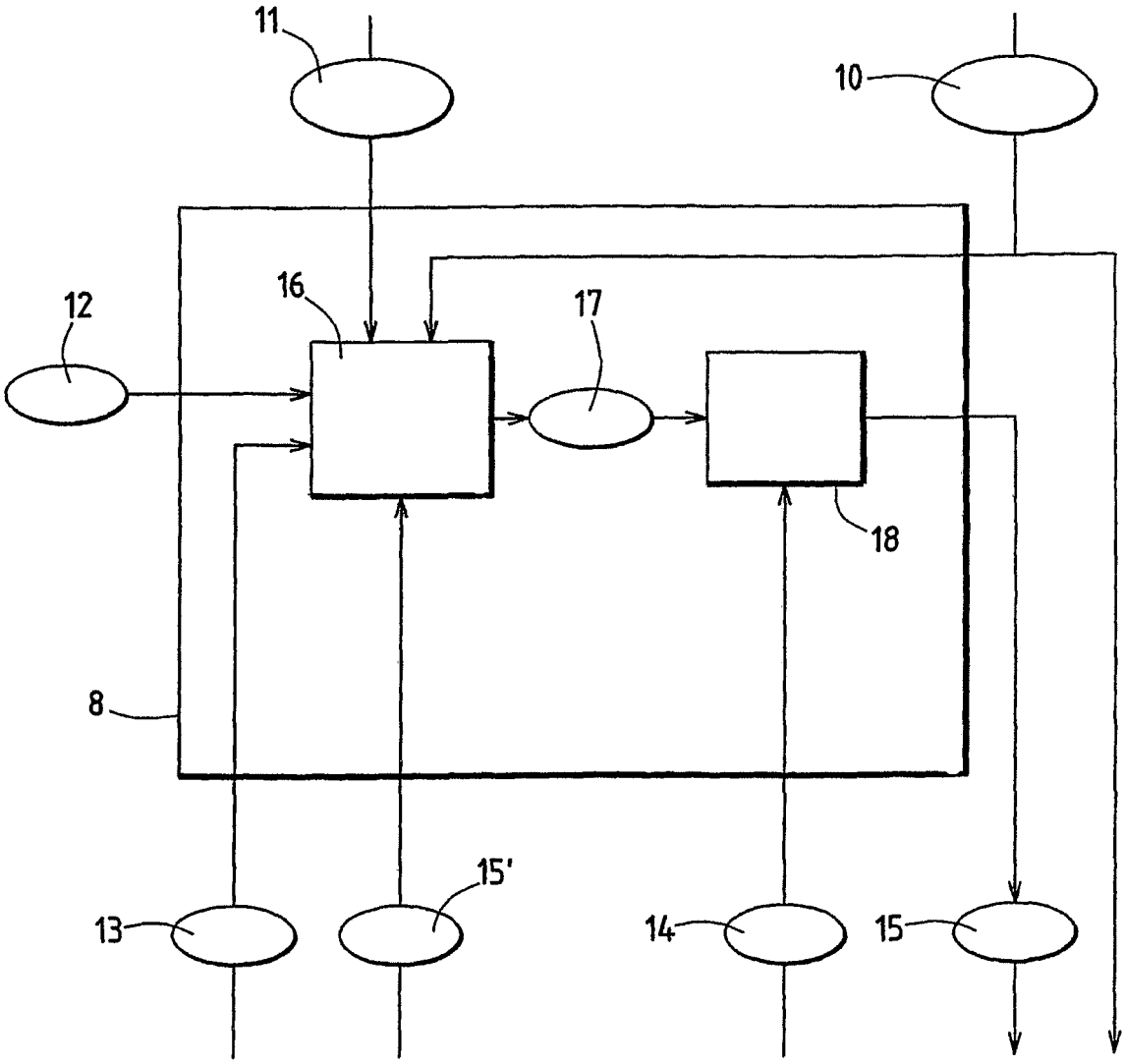
FIG. 2 is a detailed diagram of the part of the regulation process which determines the set-points to be sent to the flatness actuators of the roll stand.

In order to roll a thin metal sheet such as a strip, a continuous rolling mill including at least one static flatness actuator and at least one dynamic flatness actuator is used. These flatness actuators will be specified below.

A means for measuring flatness, which determines flatness via measurements made at different points disposed transversely over the strip, is disposed downstream of this rolling mill.

More specifically, the means for measuring flatness is for example a flatness roll whose length is equal to the width of the rolling line. A plurality of sensors, with which the strip will come into contact, are disposed at carefully-determined distances along the length of this flatness roll. The number of active sensors depends on the width of the strip. In fact, only the sensors which interfere with the strip, that is, the sensors which are disposed along a line whose length is less than or equal to the width of the strip, are activated. Furthermore, a rolled strip may be narrower than the width of the rolling line.

The device for measuring flatness thus characterises the flatness of the strip at the moment of measurement, that is, at given point, via a series of quantities each of which corresponds to the measurement from a sensor. This set of measurements forms a vector of dimension n, n being dependent on the width of the strip and equal to the number of sensors activated.

If the quantity characteristic of flatness is called D, the measurement of flatness at a given moment is represented by a column vector $$D(t) = \begin{pmatrix} D1(t) \\ D2(t) \\ \vdots \\ Dn(t) \end{pmatrix}$$

In order to eliminate or at least reduce flatness defects which can be measured on the strip at the output of the mill, it is necessary to determine the modification or modifications of setting to be made to one or more than one dynamic actuator in such a way as to compensate for the flatness error which has been measured. To do this, a model is used of the effect of each of the dynamic actuators on each of the zones for measurement of flatness and an optimisation problem is solved consisting of minimising a function of cost calculated by using, firstly, the measured flatness error and secondly, the effect of the actuators on flatness, whilst at the same time care is taken to remain within the constraints on the actions to be performed on each of the dynamic actuators in order to avoid going beyond the operating domains of these dynamic actuators, or to maintain certain settings of the roll stand which are not involved in flatness, such as, for example, the settings which have an effect on thickness. It should be stressed that, here, dynamic actuator implies a means for regulating the mill whose setting can be defined by a single parameter and which can be modified independently of the other dynamic actuators available on the mill. From this point of view, a dynamic actuator is, for example, the camber of the work rolls or the camber of the intermediate rolls, or the effect on a single actuating jack of a variable camber roll, or a sprinkler nozzle on a sprinkler bar. In fact, particularly in the case of a sprinkler bar consisting of several nozzles disposed alongside one another, each of the nozzles may be controlled individually. The same is true of the different jacks of a variable camber roll.

With this definition of a dynamic actuator, the models used to determine the actions to be performed on each of these dynamic actuators in order to regulate flatness are linear models by which the effect of a defined actuator on flatness is represented by a single-column matrix whose number of elements is equal to the number of active flatness measurement zones.

For a strip whose width is such that the measurement of flatness is performed in n separate zones, the matrix for the dynamic actuator j is a column matrix $P_j$ with n elements.

$$P_j = \begin{pmatrix} P_{1j} \\ P_{2j} \\ \vdots \\ P_{nj} \end{pmatrix}$$

Thus, the model of operation of the actuator is a model which depends on the width of the sheets of metal or strips which are to be rolled. In this model, the effect of the actuator at each of the flatness measurement points is deemed to be a linear effect, and thus proportional to the variation in adjustment of this actuator. As an example, if an actuator is an actuator of the camber of the work rolls, the adjustment parameter is the camber force. The effect of this camber on the different points disposed across the width of the strip will be quantities proportional to the camber force, the coefficient of proportionality being the corresponding coefficient from the matrix of effect of the camber. The same is true for each of the jacks of a variable camber roll.

Where the roll stand is equipped with several dynamic actuators, each of the dynamic actuators is represented by an action coefficient matrix column and thus the effect of all the actuators on flatness is represented by a rectangular matrix having n rows, where n is the number of zones in which the flatness defects of the strip are measured, and m columns, where m is the number of independent dynamic actuators.

In addition, the setting of the mill is specified by a matrix column with m elements $x=[x_j]$, each of the elements corresponding to a setting of the actuator of identical rank. The corrections to the setting relative to the current state are represented by a matrix $\Delta x=[\Delta x_j]$.

In this model, the effect on flatness of a correction to a defined setting of the mill is thus represented by a column vector $a=[a_i]$ with n rows, and which is equal to the product of the rectangular matrix of effect multiplied by the matrix column representing the variations in setting of the mill.

The matrix of effect P whose coefficients are $P_{ij}$, i ranging from 1 to n and j from 1 to m, is written thus:

$$P=[P_{ij}]=[P_1,P_2,\ldots,P_m]$$

The model is then written thus:

$$a = P \times \Delta x$$

or $$a_i = \sum_{j=1,m} P_{ij}\Delta x_j$$

The problem to be solved in order to find the optimum setting of the mill which minimises the flatness error just measured thus consists of determining the set-point vectors for the mill such that a difference between the vector of the flatness error just measured and the vector representing the effect of the dynamic actuators on flatness is as small as possible. This difference may be defined in several ways. According to a first method, this difference may be designated by the square of the norm of the difference between the error vector and the compensation vector. It is thus a quadratic optimisation method.

If $D=[D_i]$ is the flatness error vector, it is necessary to minimise the following:

$$F_{cost} = \|D - a\|^2 = \sum_{i=1,n} (D_i - a_i)^2$$

The difference may also be defined as being the maximum amplitude of the difference which exists between the flatness effects vector and the compensation vector.

This then involves minimising:

$$F_{cost} = A_{max} = \underset{k}{\mathrm{Max}}(D_k - a_k) - \underset{l}{\mathrm{Min}}(D_l - a_l)$$

Where the error is split between positive values and negative values, $A_{max}$ may be written thus:

$$F_{cost} = A_{\max} = 1/2\,\mathrm{Max}_k[|D_k - a_k| + (D_k - a_k)] + 1/2\,\mathrm{Max}_l[|D_l - a_l| + (D_l - a_l)]$$

$$k = 1, m;\ 1 = 1, m.$$

It will be noted that it is possible to combine the two approaches by trying to minimise a cost function $F_{cost}$ equal to a linear combination of the two preceding quantities:

$$F_{cost}=\lambda\|D-a\|^2+\mu A_{max}$$

$\lambda$ and $\mu$ are two scalars such that:

$$\lambda+\mu=1.$$

The economic function as just defined above assumes that the aim is to obtain a zero flatness error, that is, such that:

$$D_i=0\forall_i.$$

Moreover, for certain applications, concerning for example strips whose edges are to be rotary-sheared, it may be desirable for the rolling to lead to slight centre buckle type defects in order, for example, that the edges are properly stretched before shearing.

More generally, it may be desired to obtain a strip whose flatness measurement corresponds to a target flatness error $D_v$.

In this case, the economic functions correspond to the difference in relation to that target and are written as follows:

More generally, it may be desired to obtain a strip whose flatness measurement corresponds to a target flatness error $D_v$.

In this case, the economic functions correspond to the difference in relation to that target and are written as follows:

$$F_{cost} = \|D_V - (D - a)\|^2$$

or $$F_{cost} = \Delta A_{max} = \mathrm{Max}_k[D_{vk} - (D_k - a_k) - \mathrm{Min}_l[D_{vl} - (D_l - a_l)]$$

or again:

$$F_{cost}=\lambda\|D_v-(D-a)\|^2+\mu\Delta A_{max}$$

This calculation, which thus consists of minimising a quantity dependent on the amplitude of a difference of a calculated residual error, is performed in a domain which is defined by the setting constraints of each of the actuators. In fact, the actions which may be performed on each of the actuators are limited by the capacity of the actuators and other constraints related to the safety of the mill. For the regulation process to operate in a realistic manner, it is necessary to determine set-points for each of the actuators which are set-points compatible with the actual capabilities of the roll stand.

This means imposing constraints of the following type:

$$L_j\times\Delta x_j\leqq b_j$$

The coefficients $b_i$ may depend on the actual settings $x_i$ of the actuators.

In addition, constraints may be imposed whose effect is to decouple the regulation of flatness from other separate types of regulation, such as regulation of thickness. Such constraints are written in the form of equalities of the following type:

$$E_j\times\Delta x_j=e_j$$

Finally, it may be desired to limit the speeds of changes of setting. To do this, constraints of the following type may be incorporated:

$$\Delta x_{j\,min}\leqq\Delta x_j\leqq\Delta x_{j\,max}$$

Thus a model is obtained for optimisation under linear constraints of an economic function which is either a linear function or a quadratic function. The methods of solving such optimisation problems are methods known in themselves to the person skilled in the art. This optimisation makes it possible to determine an elementary set-point for each of the actuators, the combined total of the elementary set-points constituting an overall setting of the roll stand.

In particular, where the optimisation criterion is quadratic, the solution to the optimisation problem may use, for example, the Wolf method which consists of solving a linear problem constructed on the basis of Kuhn and Tucker conditions, using a method close to the simplex method.

These methods are known in themselves to the person skilled in the art.

Where the optimisation criterion consists of optimising the amplitude of the flatness error, expressed in the form:

$$A_{max} = 1/2\,\mathrm{Max}_k[|D_k - a_k| + (D_k - a_k)] + 1/2\,\mathrm{Max}_l[|D_l - a_l| - (D_l - a_l)]$$

it is sufficient to introduce two additional variables u and v, and to add constraints of the following type:

$$2u\geqq|D_k-a_k|+(D_k-a_k)k=1,n$$

$$2v\geqq|D_1-a_1|-(D_1-a_1)1=1,n$$

The problem thus involves minimising the difference u+v whilst satisfying all the constraints which have been defined previously.

This is a classic linear programming problem.

It will be noted that, where the economic function to be minimised is a combination of the two types of function, the optimisation problem is solved by combining the two methods above. A convex quadratic programming problem is then obtained in which the economic function to be minimised is written thus:

$$F_{cost}=\lambda\|D-a\|^2+\mu(u+v)$$

The person skilled in the art will easily understand that the above methods of problem solving are applied in the same manner when the target flatness error $D_v$ is not identically zero.

It will be noted that in this regulation process, the set-points which are determined for the dynamic actuators are set-points for adjustment of the setting of the dynamic actuators and not absolute set-points.

In fact the flatness error which is measured is a residual flatness error resulting from the characteristics of the strip and a preset setting of the roll stand, that is, from the setting which pre-exists the effect of the dynamic adjustment.

The quantities which are determined for the actuators are thus differences in setting which have to be imposed on the dynamic actuators in such a way as to compensate for the residual flatness error just measured. These quantities form a vector $\Delta x$.

In addition, and for reasons known to the person skilled in the art, in the adjustment domain, in order to ensure some stability in such a dynamic adjustment, it is necessary to add in to the economic function to be optimised costs which correspond firstly to a dynamic cost whose aim is to avoid fluctuations in adjustment between different possible solutions which are close to one another and, secondly, to a static cost which is intended to act so that the regulation process distributes the effects between the different actuators in such a way that each of the actuators remains as close as possible to its reference position.

Where x is the vector representing all the set-points of the dynamic actuators at the moment when the flatness measurement taken into account is effected, the dynamic cost is written thus:

$$C_{dyn}=(k_d\cdot\Delta x)^2$$

$k_d$ being a dynamic cost vector.

the static cost is written thus:

$$C_{stat}=k_s\cdot(x+\Delta x).$$

$k_s$ being a static cost vector.

The cost function $F_{cost}$ to be minimised is, in its most general form, written thus:

$$F_{cost}=\lambda\|D_v-(D-a)\|^2+\mu(u+v)+G_d\times C_{dyn}+G_s\times C_{stat}$$

$G_d$ and $G_s$ are savings which may be adjusted as desired.

In these conditions, the problem which is solved is, in its most general form, a convex quadratic programming problem.

Where it is decided that $\lambda=0$ and $G_d=0$, this problem is a linear programming problem.

In the embodiments which have just been described, all the dynamic actuators are taken into account in the linear or quadratic programming problem.

This does not pose any problem where the actuators exhibit linear behaviour, which is the case for all the actuators concerned, with the exception however of the sprinkler nozzles which function in an "all or nothing" manner only.

Where it is desired to take the sprinkler nozzles into account, it is possible either to use a problem solving method known as "whole numbers" to solve the programming problem, such methods being known in themselves, or to solve the programming problem without attempting to optimise the use of the sprinkler nozzles, and then to optimise the use of the sprinkler nozzles, by performing, where necessary, one or more iterations to correct local defects. In this case, the matrix P of the linear problem does not have a column corresponding to the sprinkler nozzles.

This process is of interest, not only because it is more accurate than regulation processes according to the prior art and is well-suited to complex or multiple actuators, but also because it enables the amplitude of the flatness error, which corresponds to a criterion which is non-differentiable and thus impossible to regulate via usual regulating means, to be minimised.

The regulating process just described is implemented by an automatic control having at least one computer.

The structure of this automatic control and its method of operation will now be described with reference to the drawings.

FIG. 1 shows an automatic control intended to regulate the flatness of a metal strip 1 at the output of a roll stand generally referred to by the number 2, including, in a manner which is known in itself and is non-limiting, two work rolls 3, 3' between which the strip 1 is rolled, which rest on two support rolls 4, 4'. The work rolls are driven, in a known manner, by motors which are not shown. The roll stand has static and dynamic actuators taken from among those mentioned above, and also means 5 for adjusting these different actuators.

These means are known in themselves to the person skilled in the art and are represented in the drawing in a purely symbolic manner by a square.

The means 5 for adjusting the actuators is able to receive signals specifying set-points and it may emit signals representing the actual settings of each of the actuators.

Downstream of the roll stand 2, the strip 1 passes over a means for measuring flatness 6 which may be a flatness measuring roll known in itself.

In general, the automatic flatness control includes a model of regulation 8 installed in the form of a piece of software in a process control computer.

The model of regulation 8 works out set-points for the actuators based on measurements taken on the roll stand and on the strip, using parameters determined with the aid of a simulation model 7 of the interaction of the roll stand and a strip during rolling.

The simulation model 7 is installed in the form of a piece of software in a computer which may be either the process control computer mentioned above, or a computer working off-line.

Such a simulation model of rolling on a roll stand is known in itself to the person skilled in the art. Using data about the mill and data about the strip to be rolled, for example the width of the strip, the transverse profile thickness before rolling, the nature and characteristics of the material, etc., it makes it possible to calculate, for example, the transverse profile thickness at the output of the stand, the elongation of the longitudinal fibres of the strip, the variations in the temperature of the strip, the rolling force, the rolling torque etc.

Using the characteristics of the strip at the input and the characteristics desired at the output, the model also makes it possible to determine the theoretical optimum settings of the different actuators of the mill.

Finally, by performing calculations corresponding to unitary variations in the set-points of each of the actuators, around a reference value, the simulation model makes it possible to calculate the coefficients of effect of the actuators on a flatness error. These coefficients are the coefficients $P_{ij}$ of the matrix P of the model of regulation as defined above.

The model of regulation 8 is a model which, using the matrix P corresponding to the sheet of metal to be rolled and to preset settings of the mill, calculates set-points for the dynamic actuators using the measurements of flatness.

The model of regulation 8 consists of a module 16 for solving the linear or quadratic programming problem necessary to determine the optimum set-point adjustments $\Delta x$ for the dynamic actuators, and of a module 18 intended to work out the set-points x for the dynamic actuators according firstly to the optimum adjustments of the set-points and secondly to the rolling speed.

In fact, it may be desirable to stagger the application of the set-point x. In this case, the module 18 works out, according to the rolling speed, a transmission of the set-point to the actuators in the form of a series of successive partial adjustments such that, at the end of this process, the set-point of the actuators is equal to the set-point specified by the regulation module 16.

There are two successive phases, firstly a preparatory phase prior to the rolling of a particular strip, during which the preset set-points of the roll stand and the coefficients of the model of regulation are determined, and secondly a regulation phase proper corresponding to the actual rolling of a strip.

During the preparatory phase, the characteristics 9 of a strip to be rolled (width, input thickness, target output thickness, characteristics of the metal etc.) are introduced into the simulation model 7 whose parameters 9' representative of the roll stand have been adjusted, in a manner known in itself, in order to correspond to the roll stand on which it is desired to perform the rolling. Using the simulation model 7, an overall preset setting 10 of the roll stand is calculated corresponding to the theoretical preadjustment enabling optimum rolling of a strip with the characteristics introduced into the model. This overall setting 10 consists of a vector $x_0$ corresponding to the set-points for the dynamic actuators, with as many dimensions as there are elementary dynamic actuators, and of a vector $y_0$ corresponding to the set-points for the static actuators, with as many dimensions as there are elementary static actuators.

The model also calculates a linearised model of the effect of the dynamic actuators on flatness, near to the set-points $x_0$. This linearised model is the matrix P which makes it possible to calculate the effect a on flatness of a change in set-points $\Delta x$.

This matrix of dimension n×m (n corresponding to the number of zones of measurement of flatness, and m to the number of elementary dynamic actuators) has coefficients $P_{ij}$ equal to the effect $a_i$ resulting from a unitary set-point change $\Delta x_j=1$ for the elementary actuator j. This matrix is dependent on the characteristics of the strip to be rolled and also on the preset set-points $x_0$ and $y_0$:

$P=P(x_0, y_0, \text{characteristic of the strip})$.

In addition, there are two possible methods of operation.

In a first method of operation, on each change in the strip (width, thickness, quality of the metal, etc.) the corresponding characteristics 9 are introduced into the model 7. The model then calculates the set-points $x_0$ and $y_0$ (represented in the drawing by 10) which are sent to the means 5 for adjusting the roll stand, and the matrix P corresponding to the linearised model (represented in the drawing by 11) which is sent to the model of regulation 8.

In a second method of operation, using the simulation model 7, the preset settings and the matrices of the linear model are calculated a priori for a set of strip formats providing a proper grid of the possible strip formats and qualities which it is desired to be able to manufacture. The preset settings and the linear models thus obtained are stored in files and, when a particular strip is rolled, the files are searched for the corresponding parameters which are transferred to the means for controlling the roll stand (setting of the actuators and model of regulation), as in the previous case.

During the regulation phase, which corresponds to the actual rolling of the strip 1, the simulation model 7 is not active.

The model of regulation 8 has received the quantities 11 corresponding to the matrix P, and various parameters 12 corresponding to the model of regulation which the operator may select or which a means for managing the mill may impose.

These parameters 12 are, for example:

- the target residual flatness error $D_v$;
- the coefficients λ, μ, which make it possible to select the relative weights of a quadratic criterion and of a peak-to-peak (or amplitude) criterion;
- the coefficients $G_d$ and $G_s$ which enable adjustment of the dynamic and static costs necessary to control the regulation process.

During rolling, either at regular intervals or at each turn of the flatness measuring roll 6, the model of regulation receives:

- the flatness error measurements 13 at the moment t, represented by the vector D(t);
- a measurement 14 of the speed of the mill;
- the values 15' of the settings of the dynamic actuators at the moment t, represented by the vector x(t).

The parameters 12, the flatness error measurements 13, and the settings of the actuators 15', are sent to an optimisation module 16, included in the model of regulation 8.

The optimisation module 16 is the module which formulates and solves the problem of optimisation under constraint and thus calculates a target 17 for the set-points for the dynamic actuators. This target for the set-points corresponds firstly to the vector $\Delta x(t)$, and secondly to the target set-point of the dynamic actuators at the moment $t+\Delta t$, represented by the vector:

$$x(t+\Delta t)=x(t)+\Delta x(t)$$

The target 17 for the set-points is then sent to the module 18 which, in accordance with the target response time, continually calculated using the rolling speed 14, the response times for the sensors and the actuators in order to obtain the best dynamic response, determines instantaneous set-points 15 sent at each moment to the means 5 for adjusting the stand so that, no later than the moment $t+\Delta t$, the settings of the actuators are equal to the target setpoints $x(t+\Delta t)$.

In this regard, it should be mentioned that it may be desirable to cadence the regulation process via fixed time intervals. However, it may desirable to cadence the regulation process in such a way that the transmissions of set-points are distributed regularly over the length of the strip. In this case, the time intervals should be inversely proportional to the instantaneous speed of the strip.

In the above, the cost function, excluding static cost and dynamic cost, has been defined by a quadratic difference criterion or a criterion of the maximum amplitude of the residual flatness error. However, other criteria may be selected as required.

It is sufficient for the criteria to correspond to a positive and increasing function when a norm of the residual difference in flatness is increasing.

In particular, the cost function, excluding static or dynamic cost, may be written thus:

$$F_{cost} = \sum_i \phi_i |D_{vi} - (D_i - a_i)|^{ni}$$

with $\phi_i \geqq 0$, at least one $\phi_i>0$, and $n_i>0$ and also thus:

$$F_{cost} = \operatorname*{Max}_k \phi_k [D_{vk} - (D_k - a_k)]_k^n - \operatorname*{Min}_l \phi_l [D_{vl} - (D_l - a_l)]_l^n$$

with $\phi_k$ and $\phi_1 \geqq 0$, at least one $\phi_k>0$ and $n_k$ and $n_1>0$.

and finally, it may correspond to a linear combination of the two preceding formulations. Furthermore, the regulation of flatness which has just been described takes account of the flatness error measurements, of the flatness actuator set-points and the rolling speed.

However, it may also take account of additional parameters such as the rolling force or the strip tension, which may vary during rolling and have an effect on flatness, and it may use the additional parameter or parameters to adjust preferably certain dynamic actuators whose effects have a particular interaction with the additional parameter or parameters taken into account. As an example, when the additional parameter taken into account is the rolling force, the preferred actuator may be the camber of the work rolls.

In this case, each instantaneous measurement of additional parameters is sent to the model which compares it with a reference value and deduces at least one set-point adjustment for a preferred flatness actuator. This adjustment or these adjustments are made using preferred action models obtained in the same way as the action model of the means of regulation defined above. Once these adjustments have been determined, they are introduced into the model of regulation in order to determine the optimum adjustments of the settings of the dynamic actuators via the optimisation method described above.

As has been mentioned, this process may be applied to rolling trains consisting of a succession of roll stands which may be of the "reel to reel" type or of the "continuous" type.

However, it may also be applied to individual stands.

It is equally applicable to hot rolling or cold rolling or skin pass rolling.

The means for measuring flatness may be of any type and in particular may be flatness measuring rolls such as those described for example in the patent FR 2 468 878. Where the flatness defects are visible, for example on a hot rolling mill, the means for measuring flatness may be known laser triangulation means.

The dynamic actuators are not limited to those which have been mentioned such as, for example, the variable camber support roll, described for example in the patent FR 2 553 312. Any dynamic actuator may be taken into account.

Most often, devices for controlling flatness are applicable to single-stand rolling mills or to the last stand in a multi-stand tandem mill. However, they may be applied to the other stands in a tandem mill, and in particular to the first stand.

In general, the person skilled in the art will be able to adapt the process to any type of rolling mill, for example a "Senzimir" or "cluster mill", and to any means for measuring flatness.

The invention claimed is:

1. A process for regulating flatness of a metal strip at an output from a roll stand including means for regulating flatness including at least one dynamic flatness actuator, the method comprising:

characterizing, during rolling, the flatness of the strip by measurement of a quantity D at n points distributed over the width of the strip, based on n measurements of the quantity D;

determining, using a model of an effect on flatness of regulation of flatness and an optimization method, an overall set-point for the regulating means, the overall set-point including at least one elementary set-point for a dynamic actuator, so that a calculated residual flatness error criterion is minimal, and the overall set-point is implemented by the means for regulating flatness, wherein the model of effect on flatness used to determine the overall set-point includes, for each dynamic actuator, as many submodels as there are points of measurement of the quantity D characteristic of flatness, each submodel making it possible to calculate the effect on the quantity D, at a relevant point, of a relevant dynamic actuator when a setpoint is applied to it; and wherein the calculated residual flatness error criterion is a linear combination of the quadratic difference and the maximum amplitude of the difference between the calculated residual error and a target error.

2. A process according to claim 1, wherein the overall set-point is determined such that application of the overall set-point is compatible with operational constraints of the at least one dynamic flatness actuator.

3. A process according to claim 1, wherein the at least one dynamic actuator includes one of: setting a camber of work rolls or intermediate rolls, jack for internal adjustment of the pressure of a support roll, sprinkler nozzle, tilt of the rolls.

4. A process according to claim 1, wherein the means for regulating flatness includes a plurality of dynamic actuators, the overall set-point includes an elementary set-point for each of the dynamic actuators, and to determine the overall set-point, the sum total of the effects of each of the dynamic actuators on flatness is calculated to determine the calculated residual flatness error.

5. A process according to claim 1, wherein the model of the effect of a dynamic actuator is dependent on the width of the strip.

6. A process according to claim 1, wherein the means for regulating flatness also includes at least one static flatness actuator preset before the strip is rolled, according to the width of the strip to be rolled, and the models of dynamic actuators are determined by taking into account the preset settings of the static actuators.

7. A process according to claim 6, wherein the at least one static actuator is a lateral translation of the rolls or crossing of the rolls.

8. A process according to claim 1, wherein the calculated residual flatness error criterion is an increasing positive function of at least one norm of the difference between the calculated residual flatness error and a target flatness error.

9. A process according to claim 8, wherein the calculated residual flatness error criterion is the quadratic difference of the calculated residual error and a target error.

10. A process according to claim 8, wherein the calculated residual flatness error criterion is the maximum amplitude of the difference between the calculated residual error and a target error.

11. A process according to claim 8, wherein the calculated residual flatness error criterion also includes a static cost factor and/or a dynamic cost factor.

12. A process according to claim 1, wherein the number n of points of measurement of the quantity D characteristic of flatness is dependent on the width of the strip.

13. A process according to claim 12, wherein the quantity D is measured using a flatness measuring device, or a flatness measuring roll, having a plurality of measurement zones distributed transversely across the width of the rolling line.

14. A process according to claim 1, wherein evaluation of the flatness error, definition of the set-points for the dynamic actuators, and adjustment of the dynamic actuators is performed at successive intervals of time.

15. A process according to claim 14, wherein the successive intervals of time are dependent on the running speed of the strip.

16. A process according to claim 1, wherein preadjusted settings for rolling and the models of the effect of the elementary actuators are determined using a simulation model of rolling on a roll stand.

17. A process according to claim 16, wherein, before a strip is rolled, a simulation model of rolling is used to calculate preset set-points for static and dynamic actuators appropriate to the rolling of the strip, the models of the effect of the elementary dynamic actuators are calculated by linearization near the preset settings, the roll stand is preset, and the parameters for the models of the effect of the elementary dynamic actuators are sent to a regulating device.

18. A process according to claim 1, wherein at least one additional rolling parameter is measured, or measured for rolling force or tension, and, before determining an overall set-point for the regulating means by using a model of the effect of the regulating means and an optimization method, a preferred action model is used to determine at least one adjustment of a set-point for a preferred dynamic actuator and the at least one adjustment is taken into account in determining the overall set-point for the regulating means.

19. A process according to claim 18, wherein a preferred dynamic actuator is the camber of the work rolls.

20. A process according to claim 1, implemented by computer.

21. A process according to claim 1, applied to cold rolling.

22. A computer-readable medium having, stored thereon, a set of computer-readable instructions for performing the process according to claim 1.

23. A process according to claim 1, wherein the model of effect on flatness includes the target error, and coefficients for selecting weights of a quadratic criterion and of a peak-to-peak criterion.

* * * * *